US006009978A

United States Patent [19]

Chisholm

[11] Patent Number: 6,009,978

[45] Date of Patent: Jan. 4, 2000

[54] RAIL GUAGE FACE LUBRICATING APPARATUS

[75] Inventor: Rodney Evan Chisholm, Bassendean, Australia

[73] Assignee: Craft Nominees Pty Ltd, Belmont, Australia

[21] Appl. No.: 08/945,421

[22] PCT Filed: Apr. 19, 1996

[86] PCT No.: PCT/AU96/00228

§ 371 Date: Oct. 21, 1997

§ 102(e) Date: Oct. 21, 1997

[87] PCT Pub. No.: WO96/33085

PCT Pub. Date: Oct. 24, 1996

[30] Foreign Application Priority Data

Apr. 21, 1995 [AU] Australia ..... PN2549

[51] Int. Cl.[7] ..... B61K 3/02

[52] U.S. Cl. ..... 184/3.2; 105/199.2

[58] Field of Search ..... 184/3.2; 104/279; 105/199.1, 199.2; 198/500; 239/173, 174; 307/9.1, 10.1; 701/19

[56] References Cited

U.S. PATENT DOCUMENTS

| | | | |
|---|---|---|---|
| 1,596,281 | 8/1926 | Long . | |
| 2,724,458 | 11/1955 | Allard . | |
| 2,746,565 | 5/1956 | Vorburger et al. . | |
| 2,871,980 | 2/1959 | Allard | 184/3.2 |
| 3,165,171 | 1/1965 | Baeriswyl | 184/3.2 |
| 3,760,904 | 9/1973 | Luthar | 184/3.2 |
| 4,334,596 | 6/1982 | Lounsberry . | |
| 4,726,448 | 2/1988 | Schroeder et al. | 184/3.2 |
| 4,736,818 | 4/1988 | Wolfe . | |
| 4,781,121 | 11/1988 | Kumar et al. | 239/174 |
| 5,236,063 | 8/1993 | Nelson et al. . | |
| 5,358,072 | 10/1994 | Szatkowski et al. | 184/3.2 |
| 5,463,963 | 11/1995 | Bernard et al. | 105/168 |
| 5,477,941 | 12/1995 | Kumar et al. | 184/3.2 |
| 5,598,782 | 2/1997 | Wiseman et al. | 104/7.2 |
| 5,687,814 | 11/1997 | Craig et al. | 184/3.2 |

FOREIGN PATENT DOCUMENTS

| | | |
|---|---|---|
| 118550 | 12/1942 | Australia . |
| 66566/65 | 11/1965 | Australia . |
| 27709 | 4/1971 | Australia . |
| 610 888C | 3/1935 | Germany . |
| 2353912 | 5/1975 | Germany . |
| 308763 | 9/1929 | United Kingdom . |
| 530229A | 12/1940 | United Kingdom . |
| 768208 | 4/1955 | United Kingdom . |
| WO 79/00307 | 6/1979 | WIPO . |

*Primary Examiner*—Tamara L. Graysay
*Assistant Examiner*—Chang H. Kim
*Attorney, Agent, or Firm*—Reising, Ethington, Barnes, Kisselle, et al

[57] ABSTRACT

A rail gauge face lubricating apparatus (10) comprising a delivery assembly (12) for delivering lubricant to the rail head (40) and a pump (14) for producing a pressure to deliver lubricant to the deliver assembly (12), the deliver assembly (12) comprising in part an actuable flow regulator whereby the delivery of lubricant through the delivery assembly (12) is governed by the actuable flow regulator. The delivery assembly is maintained in an appropriate position in relation to the rail gauge face by a two cylinder positioner (38) irrespective of the loading of the rail carriage that carries it.

20 Claims, 9 Drawing Sheets

RAIL GUAGE FACE LUBRICATING APPARATUS

FIELD OF THE INVENTION

The present invention relates to a rail gauge face lubricating apparatus. More particularly, the rail gauge face lubricating apparatus of the present invention is intended to allow the accurate and controlled delivery of lubricant to a rail gauge face.

DISCUSSION OF THE PRIOR ART

Lubricating devices for minimizing both the wear of wheel flanges and rails and the generation of noise thereby have typically involved the periodic application of a lubricant spray to the flange of a wheel. The lubricant spray is generally produced by way of a combination of compressed air and lubricant. There are a number of problems associated with such a system. Not all lubricant is transferred to the point of flange/rail contact. The use of a spray of lubricant often results in lubricant spraying over more than just the wheel flange as it is the nature of a spray to fan out from the spray nozzle.

Most known lubricating apparatus allow the periodic application of lubricant whereas it is desirable that lubricant be applied only when needed, for example when a rail car is travelling around a curve and the flange/rail contact is greatest.

BRIEF DESCRIPTION OF THE INVENTION

In accordance with the present invention there is provided a rail gauge face lubricating apparatus characterized by a delivery system for delivering lubricant to the rail head and a pump for producing a pressure to deliver lubricant to the delivery system, the delivery system comprising in part an actuable flow device governing the delivery of lubricant through the delivery system, wherein the actuable flow device of the delivery system is able to be influenced by a sensor able to detect the position of a bogey of a rail vehicle relative to the remainder of the rail vehicle whereby upon the rail vehicle moving through a curve, turn or corner an amount of lubricant is delivered to the rail gauge face of the rail head, the sensor comprising two members pivotally mounted to the underside of the rail vehicle having first ends thereof positioned with respect to one another and having second ends thereof mounted to the bogey of the vehicle, the first ends of the members being arranged so that relative movement therebetween is detected, that movement in turn directly or indirectly resulting in the actuation of the flow device of the delivery system.

The actuable flow device preferably comprises a piston member having a head and rod. The piston member may be maintained such that the actuable flow device is in a closed state through action of an air pressure directed to the head thereof. The sensor is preferably capable of influencing the direction of the air pressure to the head of the piston member such that lubricant is delivered through the actuable flow device.

The present invention further provides a positioning device characterized by two cylinders in fluid communication each having a single member extending therethrough dividing each cylinder into first and second compartments, each member being moveable within its cylinder, the first compartment of one cylinder being in fluid communication with the second compartment of the other cylinder and the second compartment of the first cylinder being in fluid communication with the first compartment of the other cylinder whereby movement of the member relative to the cylinder through which it passes produces a consequent movement in the member of the other cylinder, the upper end of the member of one cylinder being mounted on a bogey of a rail vehicle and its lower end having provided thereon a delivery system for application of lubricant to a rail gauge face of a rail head.

Preferably, the fluid communication between the compartments of the cylinders is provided with an adjuster for adjusting the volume of fluid held in the compartments interconnected thereby.

The present invention still further provides a method for the consistent and accurate application of a lubricant to a rail gauge face characterized by there being provided a delivery system for delivering lubricant to the rail gauge face of the rail head and a pump for producing a pressure to deliver lubricant to the delivery system, the delivery system comprising in part an actuable flow device whereby the delivery of lubricant through the delivery system is governed by the actuable flow device, the actuable flow system being operable by a sensor able to detect the position of a bogey of a rail vehicle relative to the remainder of the rail vehicle.

DESCRIPTION OF THE DRAWINGS

The present invention will now be described, by way of example only, with reference to two embodiments thereof and the accompanying drawings, in which:

FIG. 13 is a segmented view taken along lines 13—13 shown in FIG. 12.

DESCRIPTION

Figure 1:
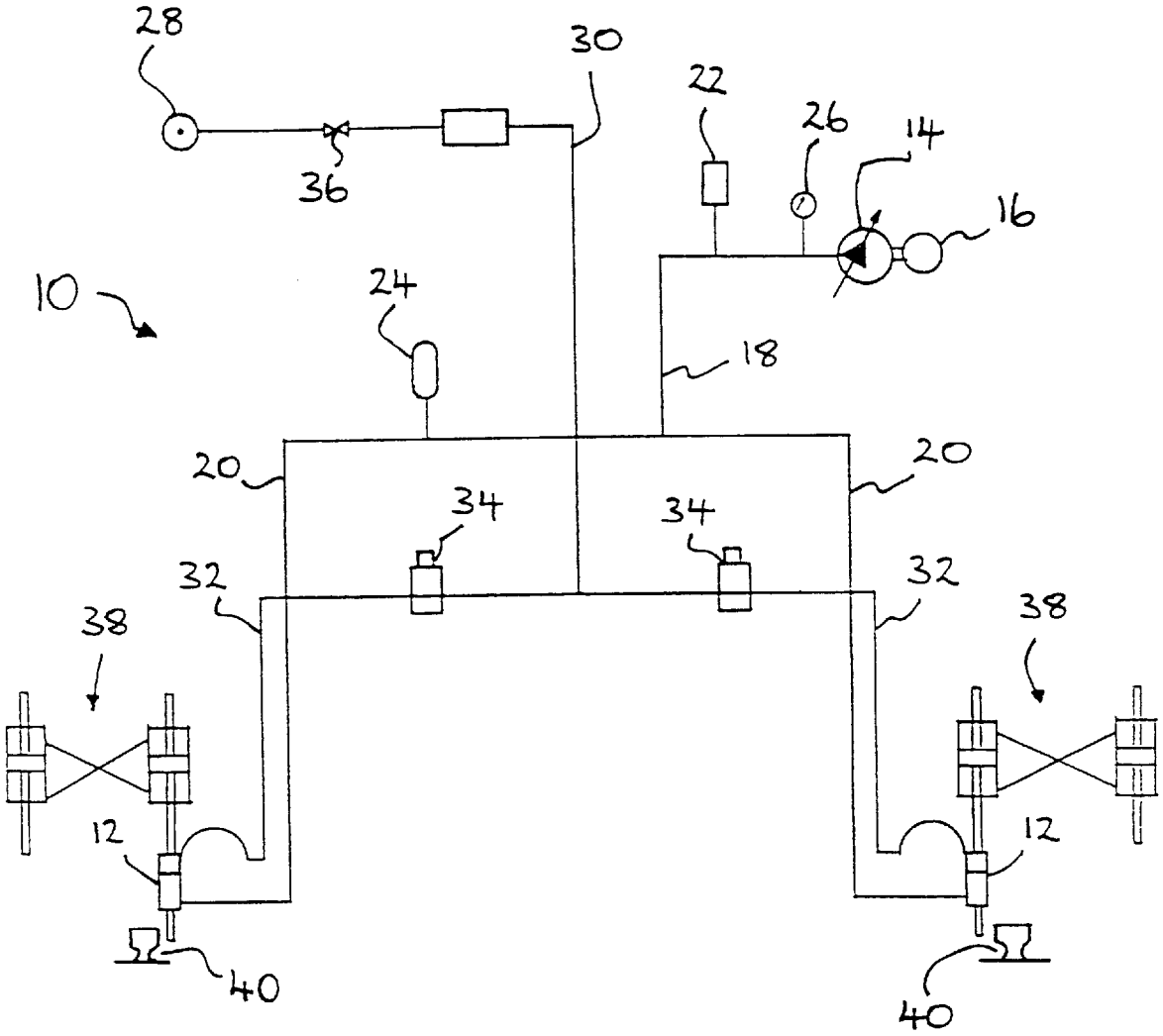
FIG. 1 is a schematic diagram of a rail gauge face lubricating apparatus in accordance with one embodiment of the present invention.
Figure 2:
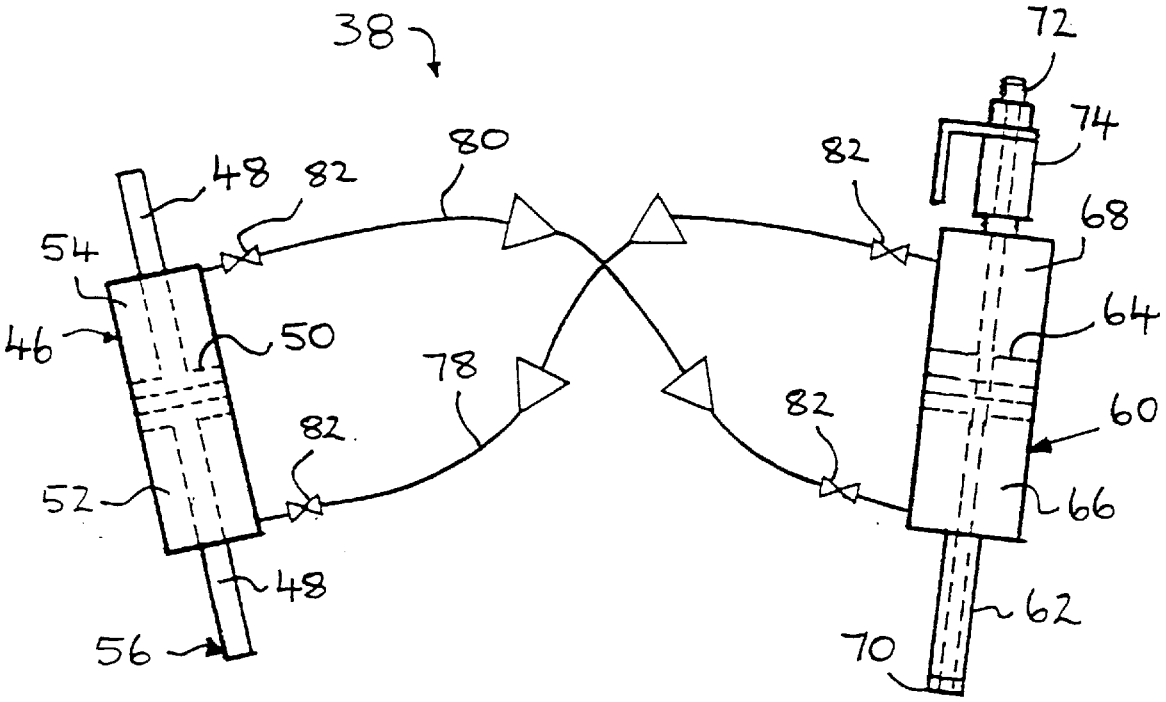
FIG. 2 is a schematic cross-sectional view of a positioning device in accordance with a second embodiment of the present invention.

In FIG. 1 there is shown a rail gauge face lubricating apparatus 10 comprising in part a pair of delivery system, for example valves 12 and a single pump 14. The pump 14 may be electric, hydraulic or pneumatic and has a motor 16 associated therewith. The pump 14 and the valves 12 are interconnected by a fluid line 18 whereby pressure on the fluid in the fluid line 18 is transferable to each valve 12. The fluid line 18 bifurcates into two branches 20, each branch 20 extending to one valve 12.

The fluid line 18 has provided therein a differential pressure switch 22 having the ability to start and stop the motor 16 driving the pump 14. In this manner a desired pressure range may be maintained in the fluid line 18. It is envisaged also that an accumulator 24 may be provided in the fluid line 18 so as to maintain a more accurate pressure in the fluid line 18. A gauge 26 is provided in the fluid line 18 to allow ready determination of the pressure of the fluid therein. Typically a lubricating grease will be the fluid or lubricant provided in the supply line, although oil, a water and glycol mixture or other suitable fluid may be utilized.

An air intake 28 is provided at the beginning of an air supply line 30 that also bifurcates into two branches 32. Each of the two branches 32 lead to a valve 12 and each has a solenoid valve 34 provided inline. The line 30 has an isolation valve 36 located therein also.

It is envisaged that the pressure switch 22 may be replaced with two pressure switches, one in each branch 20, or a single analogue pressure switch.

The valves 12 are each provided in direct connection with a positioning device 38, best seen in FIGS. 2 and 5 to 7, governing the position of the valve 12 relative to an inner rail gauge face of a rail head 40. The rail heads 40 form a portion of the rail pair that form the rail track.

A programmable logic controller (PLC) is provided governing the operation of the solenoid valves 34, the motor 16, the differential pressure switch 22 and a sensor 42 (best seen in FIGS. 4 and 12) provided to detect when a rail vehicle to which the apparatus 10 is fitted is travelling around a curve. The PLC performs the function of monitoring the entire apparatus 10. For example, the PLC can detect low fluid levels in the fluid/grease reservoir for the pump 14 which may be caused through leakages in the lines 18 and 20. Further, the PLC could shut one branch of the apparatus down if a breakage occurs in that branch with for example a nozzle (discussed later) being lost. The connection of the PLC to a wheel tachometer would allow the application of fluid by distance rather than time.

Further, the PLC is able to determine, in combination with the sensing means 42 which rail's rail gauge face is to have lubricant applied thereto. For example, in a right hand curve it is appropriate to apply lubricant to the left hand rail gauge face. The PLC may be modified to allow delivery of lubricant on tangent tracks.

In FIGS. 2 and 4 to 7 there is shown the positioning device 38 comprising in part a first sealed cylinder 46 having an elongate member 48 passing therethrough and by way of an intermediate flange 50 provided thereabout dividing the cylinder 46 into a first compartment 52 and a second compartment 54. The member 48 is fixedly attached at a lower end 56 thereof to a point 57 on the suspension system of a rail vehicle 58 (shown in FIG. 3) and the cylinder 46 is attached thereto at another point 59 whereby when the vehicle is loaded and unloaded the member 48 moves relative to the cylinder 46 thereby altering the volume of the compartments 52 and 54.

Figure 3:
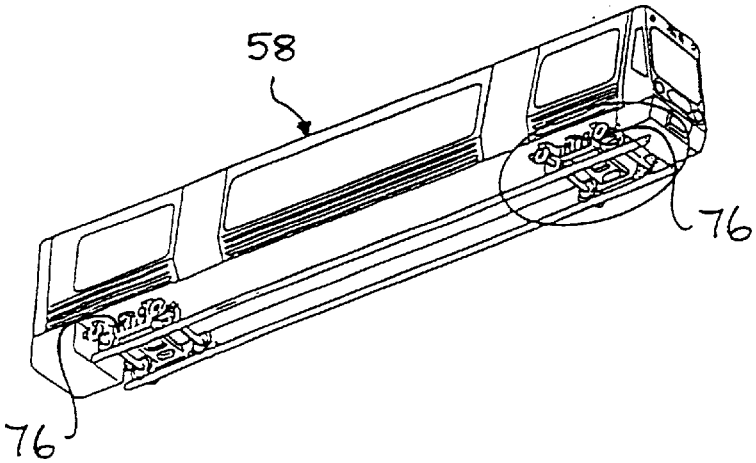
FIG. 3 is a lower perspective view of a rail carriage to which rail gauge face lubricating apparatus of FIG. 1 and positioning device of FIG. 2 have been fitted.
Figure 4:
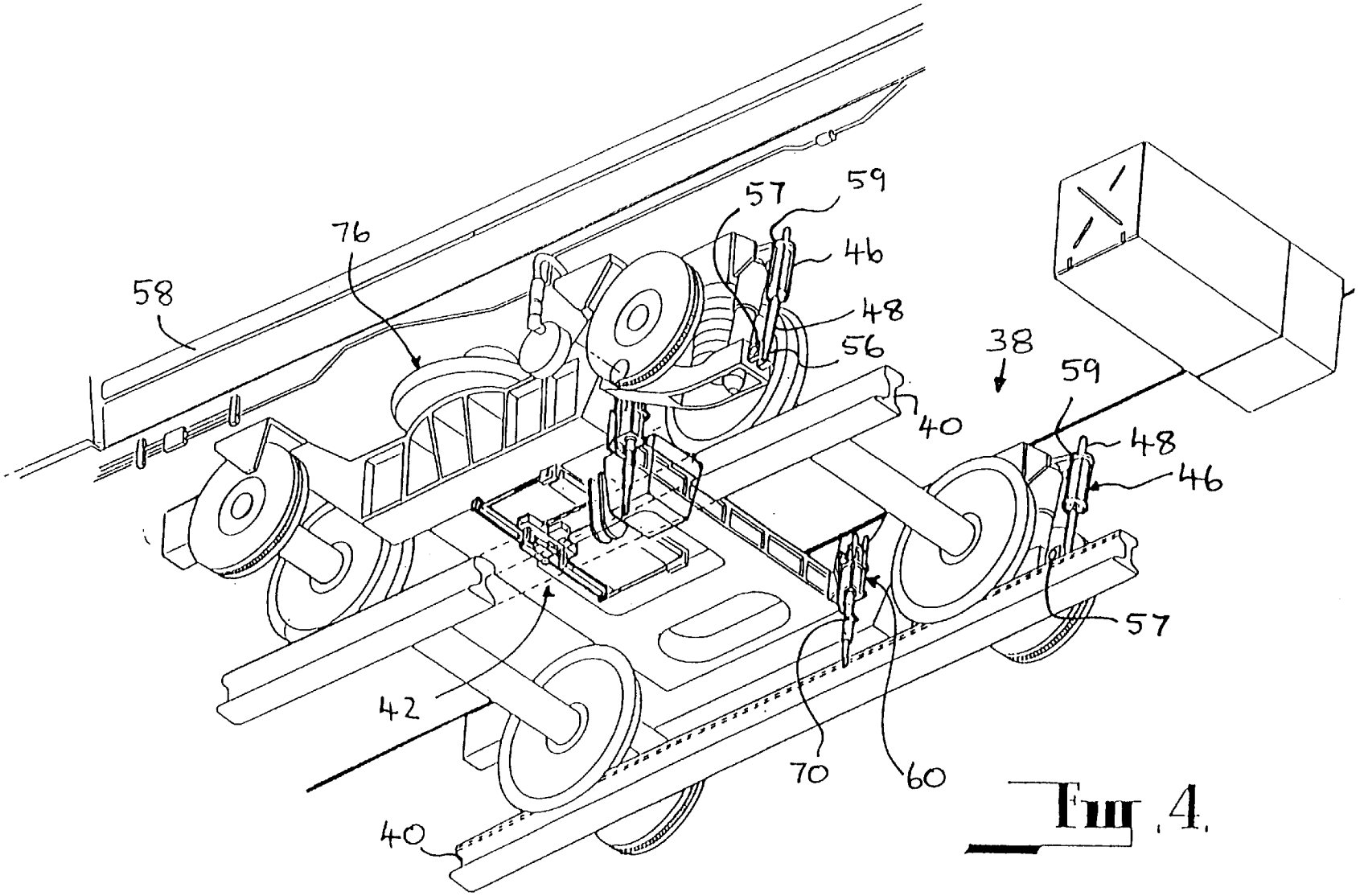
FIG. 4 is a second lower perspective view of the apparatus of FIG. 1, positioning means of FIG. 1 and a sensor, each in position on the rail carriage of FIG. 3.
Figure 5:
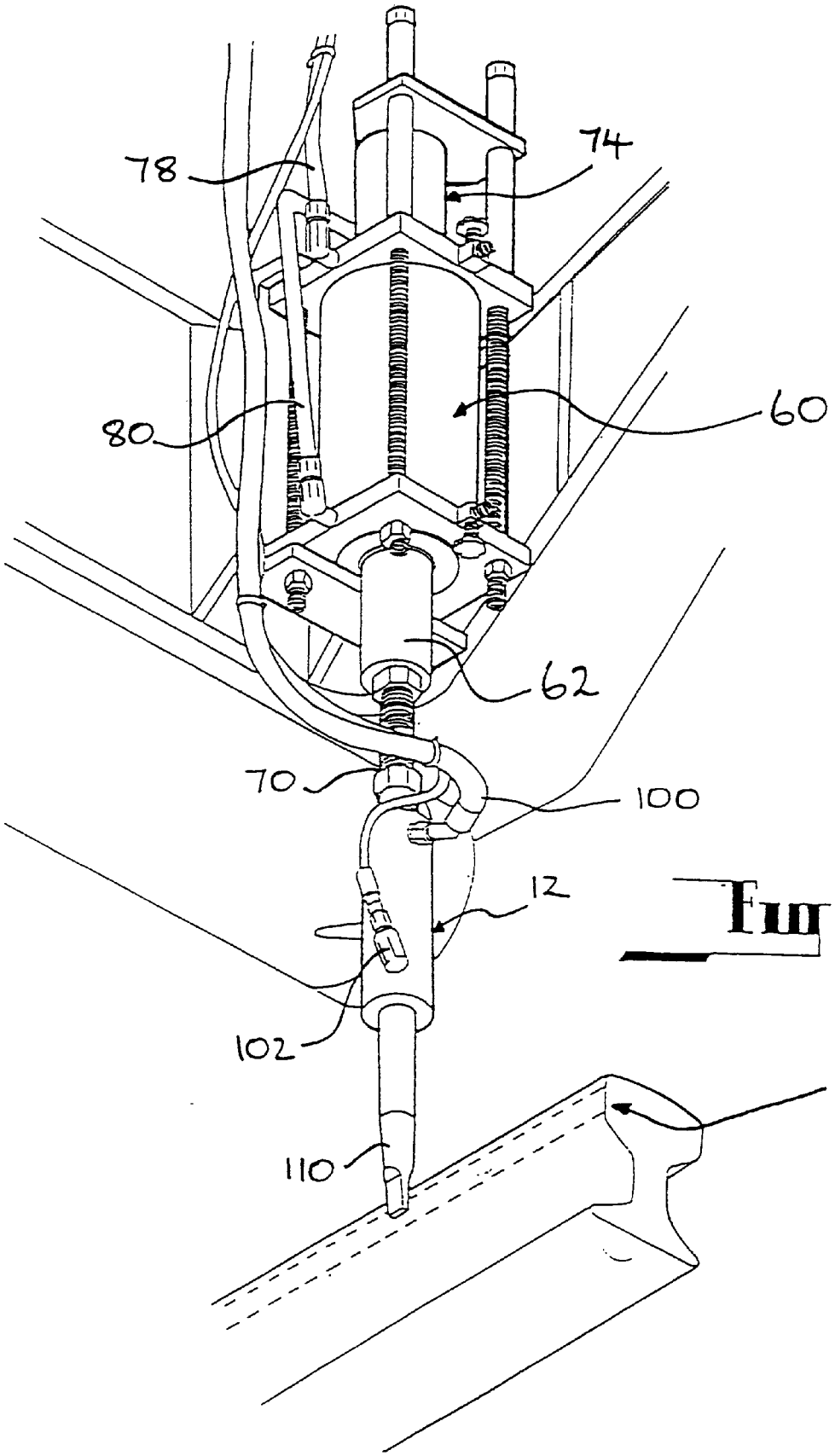
FIG. 5 is a lower perspective view of a second cylinder of the positioning device having a delivery system actuable flow device and nozzle provided thereon.

The positioning device 38 further comprises a second sealed cylinder 60 having an elongate hollow member 62 having an elongate hollow member 62 extending therethrough and by way of an intermediate flange 64 dividing the cylinder 60 into a first compartment 66 and a second compartment 68. A lower end 70 of the member 62 is fixedly and adjustably attached to the valve 12. An upper end 72 of the member 62 has provided thereabout a collar 74 to limit the travel of the member 62 through the cylinder 60 is supported on a bogey 76 of the rail vehicle 58, as is seen in FIGS. 3 and 4.

A fluid line 78 is provided connecting compartments 52 and 68 whereas a fluid line 80 is provided connecting compartments 54 and 66. Each line 78 and 80 has provided therein one or more bleed valves 82.

Figure 6:
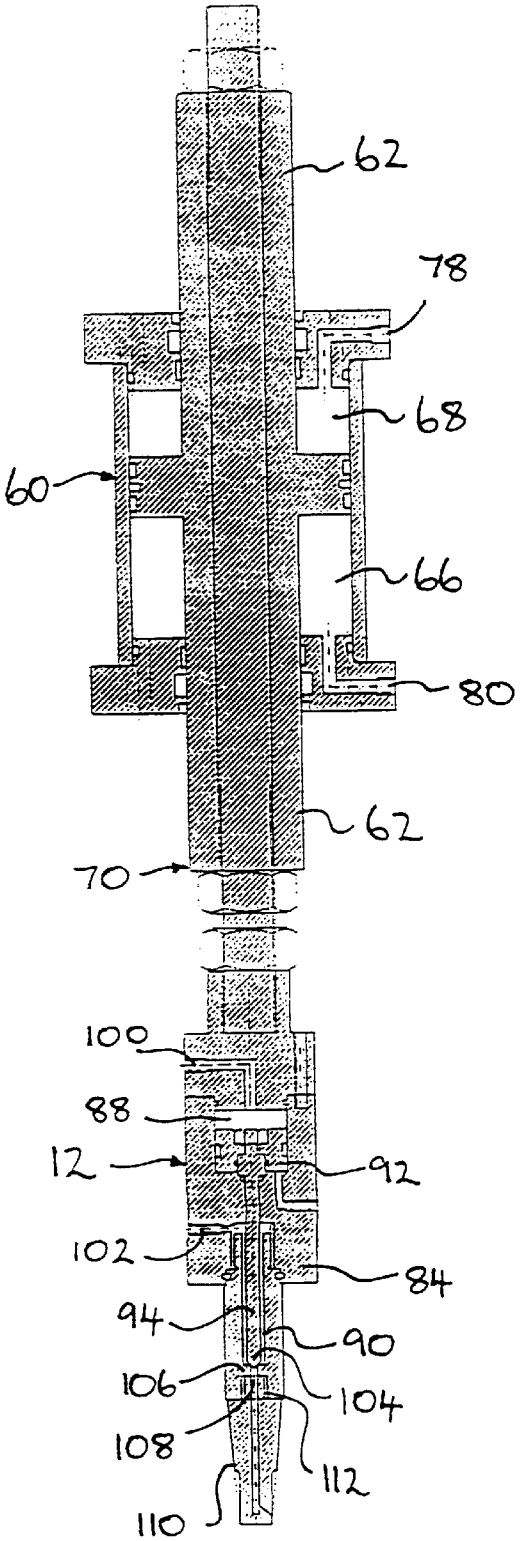
FIG. 6 is a cross-sectional side view of the first cylinder of FIG. 5.
Figure 7:
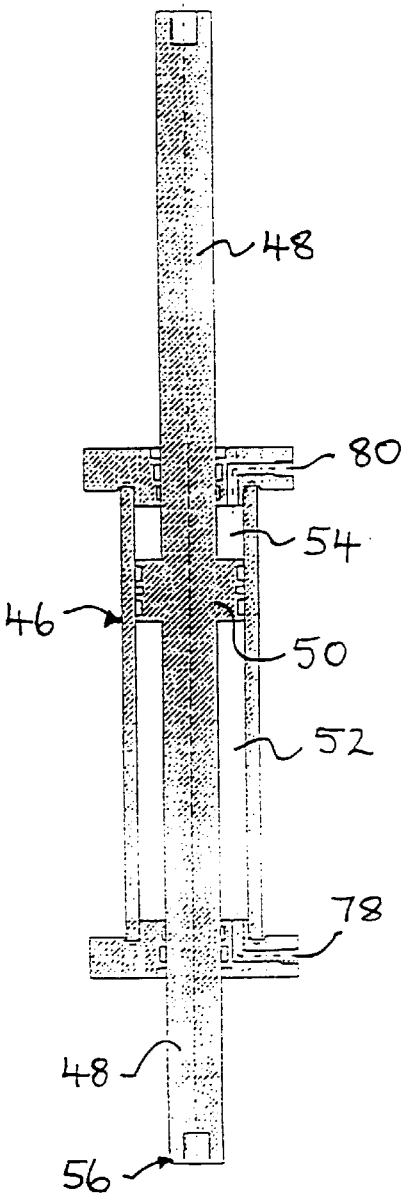
FIG. 7 is a cross-sectional side view of a second cylinder of the positioning means of FIG. 2.
Figure 11:
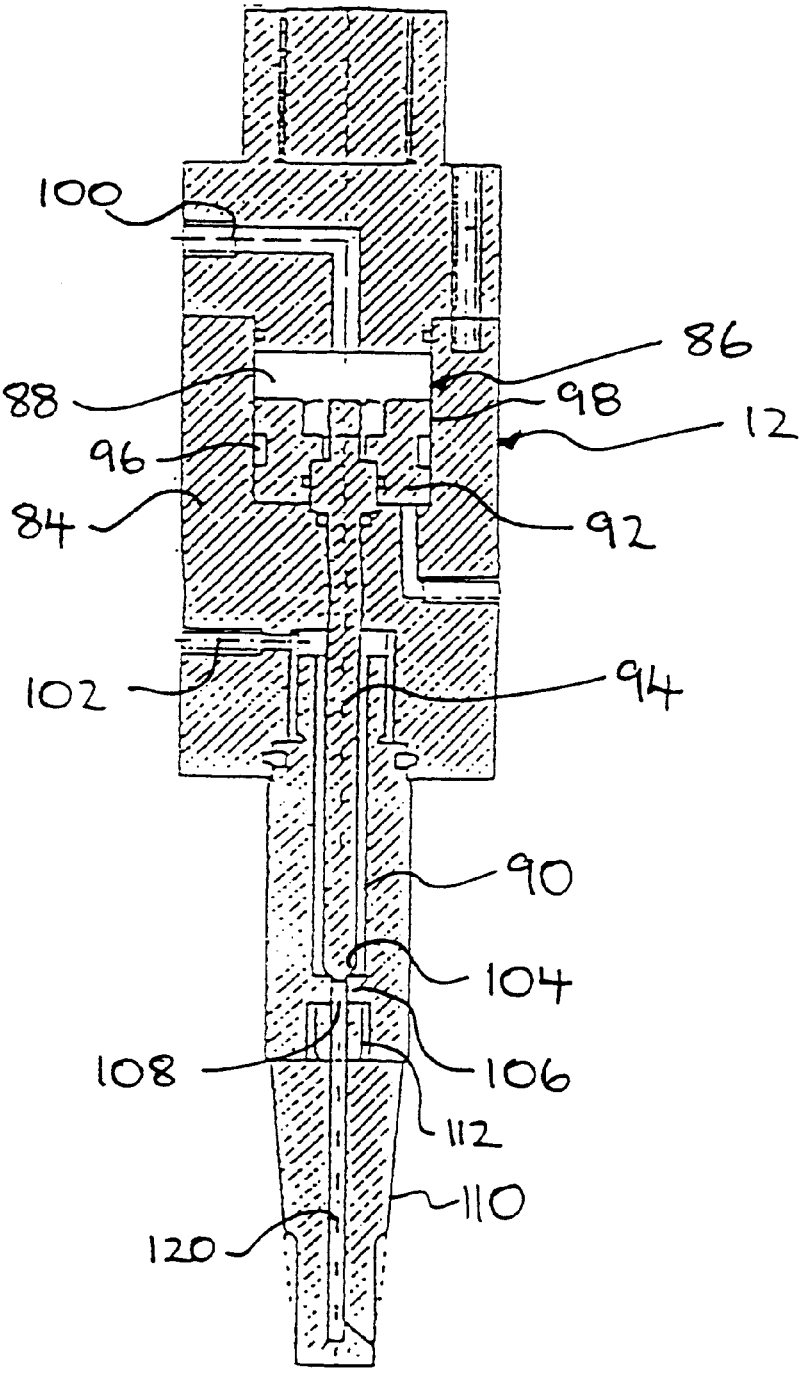
FIG. 11 is a cross-sectional side view of the delivery system of FIG. 5.

In FIGS. 6 and 11 there is shown a valve 12 comprising an outer housing 84 and an inner cylinder bore 86. The bore 86 defines an area 88 of wide diameter and an area 90 of comparatively narrow diameter in which a rigidly interconnected piston head 92 and rod 94 are located respectively. The head 92 and rod 94 together provide a piston member. A seal 96 is provided between the head 92 and internal walls 98 of the area 88. An inlet 100 for the branches 32 of the air supply line 30 opens into the area 88. An inlet 102 for a branch 20 of the fluid line 18 is provided into the area 90.

The rod 94 has a lower end 104 provided with a bevelled surface which acts to engage a shoulder or seat 106 in the area 90. From the area 90 an outlet 108 is located through the seat 106 whereby movement of the rod 94 into and out of engagement with the seat 106 controls fluid flow from the inlet 102 to and from the outlet 108.

Figure 8:
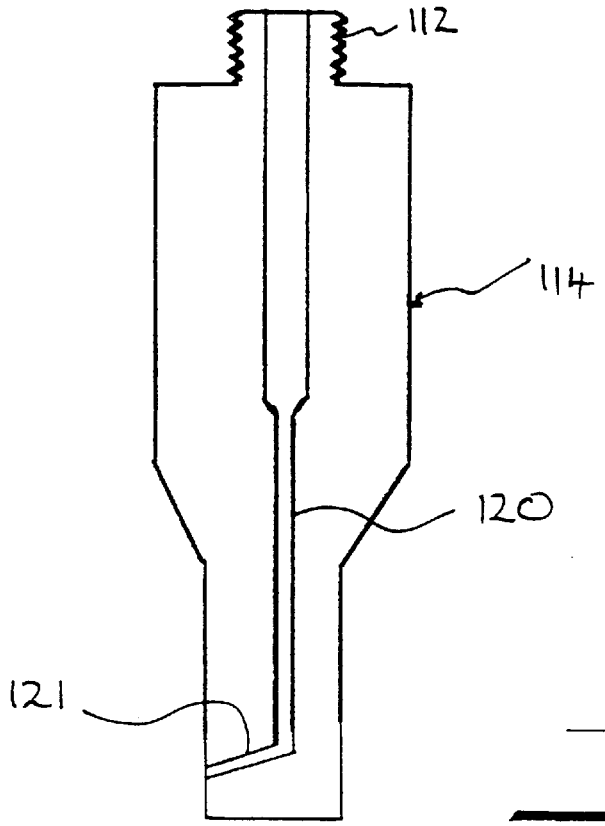
FIG. 8 is a cross-sectional side view of a nozzle for use on the delivery system of FIG. 5.
Figure 9:
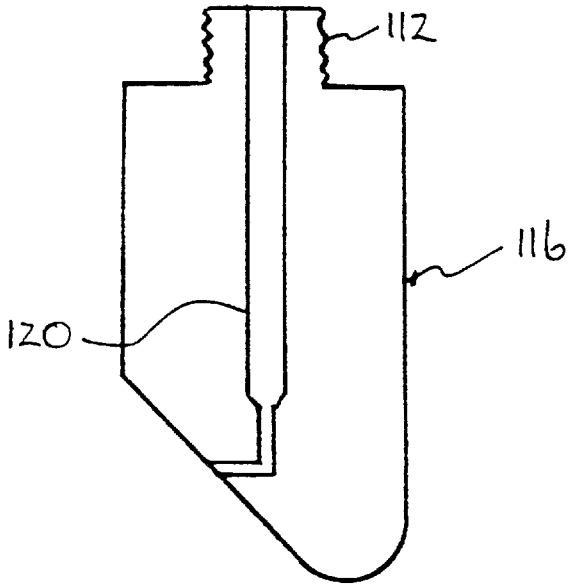
FIG. 9 is a cross-sectional side view of a nozzle for use on the delivery system of FIG. 5.
Figure 10:
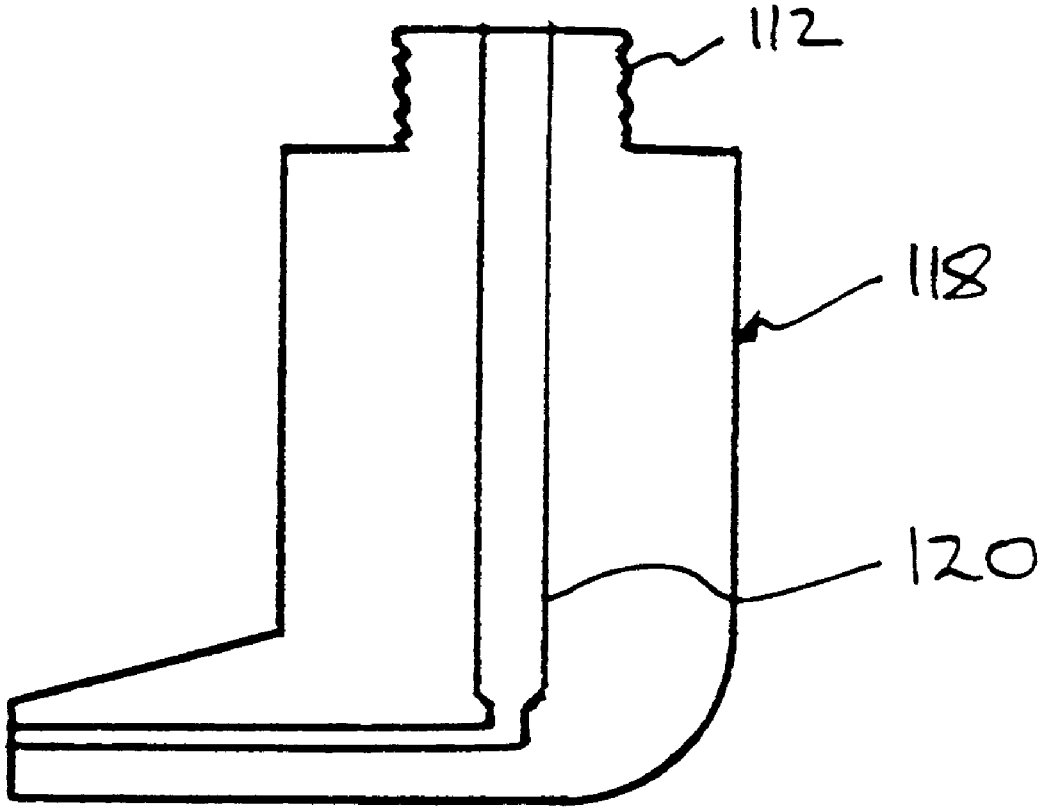
FIG. 10 is a cross-sectional side view of a nozzle for use on the delivery system of FIG. 5.

A nozzle 110 is provided in engagement with the valve 12 adjacent the outlet 108 such that fluid flow therefrom will pass through the nozzle 110. The nozzle 110 has provided thereon a threaded spigot 112 allowing attachment to a complimentary thread on the outlet 108 of the valve 12 and through which fluid is transferred to the rail gauge face of the rail head 40. A variety of nozzles 114, 116, and 118 are shown in FIGS. 8, 9, and 10 and like numerals denote like parts. Each nozzle 110, 114, 116 and 118 has a passage 120 provided therein for the passage of lubricating fluid. The fluid is preferably projected from the nozzles 110, 114, 116 and 118 as a stream rather than a spray. Nozzle 114 preferably has a terminal portion 121 of the passage 120 provided at approximately 72° to the vertical (as opposed to 90° as shown in nozzles 116 and 118). This causes the nozzle 114 to project a stream of lubricant that impinges upon the rail gauge face of the rail head 40 at an acute angle and spreads downwardly only, rather than spreading upwardly also (as is seen when the stream hits the face at 90° ) which can cause some lubricant to spread to an upper face of the rail head 40. The terminal portion 121 of the passage 120 preferably is drilled to about 0.5 ml to 1.0 ml diameter. This ensures maintenance of a back pressure in the fluid line 18 thereby preventing rapid loss of pressure.

Figure 12:
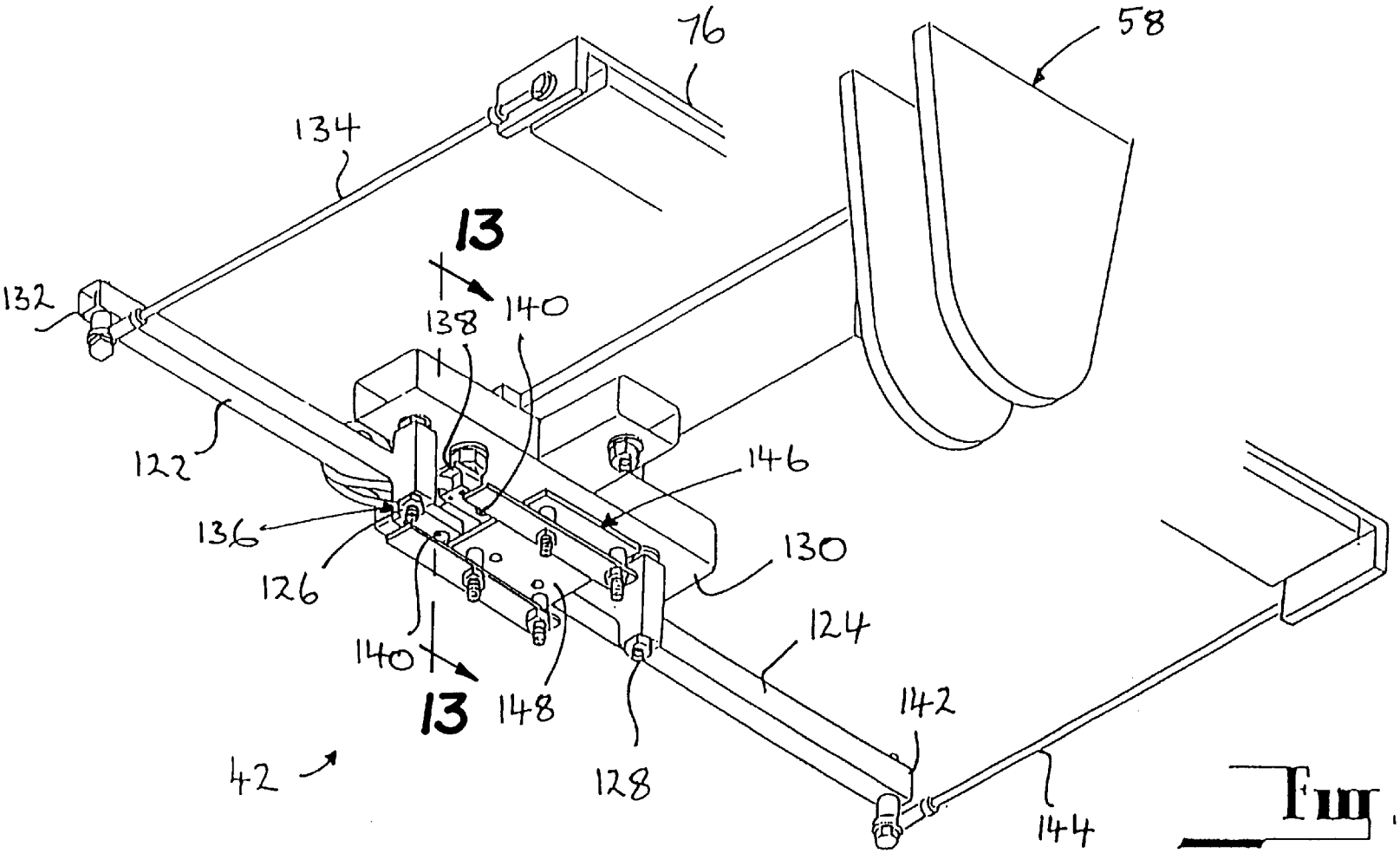
FIG. 12 is a lower perspective view of a sensor of the apparatus of FIG. 1.

The sensor 42 comprises two members 122 and 124 pivotally mounted at points 126 and 128, respectively to a base mounting member 130 as is best seen in FIG. 12. The points 126 and 128 are intermediate the ends of the members 122 and 124. The member 122 has a first end 132 pivotally mounted by way of a guide bar 134 to the bogey 76 on which the rail vehicle 58 is supported. A second end 136 of the member 122 is provided with a U-shaped member 138 having a proximity switch 140 located on each arm thereof. The proximity switches 140 are linked electrically to the PLC.

The member 124 has a first end 142 pivotally mounted indirectly to the bogey 76 by way of a guide bar 144 whilst a second end 146 has provided thereat a wider U-shaped member 148 than the member 138. The members 138 and 148 are positioned in different lateral planes allowing at least a portion of the member 148 to pass over some or all of the member 138 and the switches 140 upon turning of the bogey 76 relative to the remainder of the rail vehicle 58.

In use, upon varying of a load carried by the rail vehicle 58 the suspension of that vehicle will adjust accordingly whereby the elongate member 48 will move with respect to the first cylinder 46 thereby producing a consequent movement in the elongate member 62 in the cylinder 60 through transfer of fluid between the compartments thereof. For example, if a greater load was applied to the rail vehicle 58 then the elongate members 48 will move upwardly with respect to the cylinder 46 and the volume of the second compartment 54 will decrease thereby forcing fluid through the fluid line 80 to the first compartment 66 of the cylinder 60. This reduces a consequent movement in the elongate member 62 thereby adjusting the position of the valve 12 affixed to the lower end 70 of the elongate member 62. The interaction of the cylinders 46 and 60 and the resultant positioning of the valve 12 with respect to the rail gauge face of the rail head 40 is shown clearly in FIG. 4.

It is important to note that the volume of the cylinders 46 and 60 is provided in a predetermined ratio, as the volume or magnitude of movement in the elongate member 48 caused by loading or unloading of the rail vehicle 58 will typically not be of the same magnitude required in the elongate member 62 to adjust the positioning of the valve 12 connected thereto with respect to the rail gauge face of the rail head 40. Further, the bleed valves 82 provided in the fluid lines 78 and 80 allow the purging of the compartments 52, 54, 66 and 68 and allow adjustment of the fluid levels therein so as to allow accurate setting of the positioning means 38. A threaded rod running through the hollow elongate member 62 allows the adjustment of the height of the valve 12 and the collar 74 provided about the upper end of the elongate member 62 ensures there is a maximum volume or magnitude of downward movement of the elongate member 62 so as to not damage the valve 12 located thereon.

A pressure of between 150 and 300 bar is maintained in the fluid line 18 through the interaction of the pump 14, the motor 16, the differential pressure switch 22 and the PLC. The pressure switch 22 detects when the pressure of the fluid in the fluid line 18 reaches either of the extremes and causes the motor 16 to either stop or actuate the pump 14. The pressure in the fluid line 18 is able to be readily determined by way of the pressure gauge 26.

The air supply line 30 delivers an air pressure through the branches 32 thereof into the area 88 of the valve 12. The air pressure acts upon the broad head 92 of the piston thereby preventing passage of fluid into the fluid inlet 102 and through the outlet 108 whereby it could have been delivered to the rail gauge face of the rail head 40. The solenoid valves 34 provided in the branches 32 of the air supply line 32 may be caused to close by the PLC if the PLC is provided with an appropriate signal from the sensor 42. The sensor 42 may provide such a signal from one or both of the proximity switches 140 if the position of the bogey 76 of the rail vehicle 58 changes relative to that rail vehicle 58 upon which the base mounting member 130 is located. The closing of the solenoid valves 34 allows the pressure maintained in the fluid line 18 to cause the movement of the rod 94 of the piston upwardly thereby opening the fluid inlet 102 allowing fluid to flow therethrough and out the fluid outlet 108 into the nozzle 120 attached thereto. Upon the signal from the sensor 42 no longer being received by the PLC, such will again open the solenoid valves 34 thereby allowing the air pressure to again act on the broad head 92 of the piston in the valves 12. It is important to note that the fluid delivery from the fluid outlet 108 is airless and delivers only the lubricant at the predetermined rate. The area 88 of the inner cylinder bore 86 also has located therein an air vent allowing the movement of the broad head 92 of the piston.

It is envisaged that the valves 12 may be alternatively actuated by a different form of fluid or by an electrical device in the form of a solenoid valve. It is further envisaged that the sensor 42 may produce a signal from optical, pneumatic or hydraulic means and derivatives thereof. Further, electrical switching utilizing switches other than the proximity switches 140 is envisaged to fall within the scope of the present invention.

Importantly, the rail gauge face lubricating apparatus of the present invention allows automatic adjustment of the position of the lubricant delivery system, being the valve 12, relative to the bogey 76 such that it will maintain a constant position in relation to the rail gauge face of the rail head 40 under all loading conditions of the rail vehicle 58. As such, irrespective of the load being carried by the rail vehicle 58 the nozzles will apply lubricant to the same position on the rail gauge face of the rail head 40.

The particular structure of the sensor 42 of the present invention allows limited forward and rearward movement of the bogey 76 with respect to the rail vehicle 58 without switching of the proximity switches 140. Such an arrangement is advantageous and necessary so as to prevent switching upon the common minor forward and rearward movements of the bogey 76 with respect to the rail vehicle 58 as are commonly experienced.

Modifications and variations such as would be apparent to the skilled addressee are considered to fall within the scope of the present invention.

I claim:

1. A rail gauge face lubricating apparatus characterized by a delivery system delivering lubricant to a rail head and a pump for producing a pressure to deliver lubricant to the delivery system, the delivery system comprising in part an actuable flow device governing the delivery of lubricant through the delivery system, wherein the actuable flow device of the delivery system is able to be influenced by a sensor able to detect a position of a bogey of a rail vehicle relative to a remainder of the rail vehicle whereby upon the rail vehicle moving through a curve, turn or corner an amount of lubricant is delivered to the rail head, the sensor comprising two members pivotally mounted to an underside of the rail vehicle having first ends thereof positioned with respect to one another and having second ends thereof mounted to the bogey of the vehicle, the first ends of the members being arranged so that relative movement therebetween is detected, that movement in turn resulting in the actuation of the flow device of the delivery system.

2. A rail gauge face lubricating apparatus according to claim 1, characterized in that the rail vehicle is supported on a pair of rails and wherein a rail gauge face of each rail is provided with a delivery system, the sensor being able to determine which rail requires lubricant delivery upon the rail vehicle traversing a curve, turn or corner.

3. A rail gauge face lubricating apparatus according to claim 2, characterized by overlying ends of the members being provided with one of electrical, optical, pneumatic and hydraulic switches located thereon.

4. A rail gauge face lubricating apparatus according to claim 3, characterized by said switches being electrical proximity switches to detect movement of one member with respect to the other member.

5. A rail gauge face lubricating apparatus according to claim 4, characterized such that the second ends of the members are mounted to the bogey indirectly by way of guide bars attaching thereto a point remote from each member thereby allowing a degree of forward and rearward movement in the bogey relative to the rail vehicle without triggering of the switches.

6. A rail gauge face lubricating apparatus according to claim 5, characterized in that the overlying ends of the members are each provided with a U-shaped member, one being of a greater width than the other and the proximity switches being located in pairs on the U-shaped members.

7. A rail gauge face lubricating apparatus according to claim 4, characterized in that the overlying ends of the members are each provided with a U-shaped member, one being of a greater width than the other and the proximity switches being located in pairs on the U-shaped members.

8. A rail gauge face lubricating apparatus according to claim 1, characterized by the overlying ends of the members are provided with one of electrical, optical, pneumatic and hydraulic switches located thereon.

9. A rail gauge face lubricating apparatus according to claim 8, characterized such that the second end of each member is mounted to the bogey indirectly by way of guide bars attaching thereto a point remote from each member thereby allowing a degree of forward and rearward movement in the bogey relative to the rail vehicle without triggering of the switches.

10. A rail gauge face lubricating apparatus according to claim 9 characterized in that the overlying ends of members are each provided with a U-shaped member, one U-shaped member being of a greater width than the other U-shaped member, proximity switches being located in pairs on the U-shaped members.

11. A rail gauge face lubricating apparatus according to claim 1, characterized in that the actuable flow device comprises a piston member having a head and rod, the head having an air pressure applied thereto to hold the flow device in a closed state thereby restricting the flow of lubricating fluid.

12. A rail gauge face lubricating apparatus according to claim 11, characterized by the actuable flow device forms a part of a valve.

13. A rail gauge face lubricating apparatus according to claim 12, characterized in that the sensor is able to influence direction of the air pressure to the head of the piston member such that lubricant is delivered through the actuable flow device.

14. A rail gauge face lubricating apparatus according to claim 13, characterized by the lubricant being delivered from a nozzle attached to the valve in a stream.

15. A rail gauge face lubricating apparatus according to claim 13, characterized by the lubricant being delivered to the rail gauge face at an acute angle thereto.

16. A rail gauge face lubricating apparatus according to claim 11, characterized in that the sensor is able to influence direction of the air pressure to the head of the piston member such that lubricant is delivered through the actuable flow device.

17. A positioning device characterized by two cylinders in fluid communication each having a single member extending therethrough dividing each cylinder into first and second compartments, each member being moveable within its cylinder, the first compartment of one cylinder being in fluid communication with the second compartment of the other cylinder and the second compartment of the first cylinder being in fluid communication with the first compartment of the other cylinder whereby movement of one member relative to said one cylinder produces a consequent movement in the member of the other cylinder, an upper end of the member of one cylinder being mounted on a bogey of a rail vehicle and a lower end of that member having provided thereon a delivery system for application of lubricant to a rail gauge face of a rail head.

18. A positioning device according to claim 17, characterized in that the fluid communication between the compartments of the cylinders is provided with an adjuster for adjusting the volume of fluid held in the compartments interconnected thereby.

19. A positioning device according to claim 18, characterized by the lower end of the member of the other cylinder being attached to a point on the suspension system of the rail vehicle whereas the cylinder itself is attached at a separate point whereby upon loading/unloading of the rail vehicle the member of the other cylinder moves relative to that cylinder and thereby altering the positioning of the member of the one cylinder and the delivery system attached thereto.

20. A method for the consistent and accurate application of lubricant to a rail gauge face wherein there is provided a delivery system for delivery of lubricant to a rail head and a pump for producing a pressure to deliver lubricant to the delivery system, the method characterized by the steps of:

detecting relative movement between two members of a sensor, the members having first ends thereof positioned with respect to one another and having second ends thereof mounted to a bogey of a rail vehicle; and the sensor influencing an actuable flow device to cause delivery of lubricant to a rail gauge face upon the sensor detecting movement in the rail vehicle whilst traversing a curve, turn or corner.

* * * * *